US006837715B2

(12) United States Patent
Beno

(10) Patent No.: US 6,837,715 B2
(45) Date of Patent: Jan. 4, 2005

(54) DRY ERASE AND TACK DISPLAY BOARD HAVING NO FRAME

(75) Inventor: Steve Beno, Skokie, IL (US)

(73) Assignee: General Binding Corporation, Skokie, IL (US)

( * ) Notice: Subject to any disclaimer, the term of this patent is extended or adjusted under 35 U.S.C. 154(b) by 89 days.

(21) Appl. No.: 09/799,830

(22) Filed: Mar. 6, 2001

(65) Prior Publication Data

US 2002/0160352 A1 Oct. 31, 2002

(51) Int. Cl.[7] ..... B43L 1/00
(52) U.S. Cl. ..... 434/408
(58) Field of Search ..... 434/408, 413–416, 434/417, 430, 421; 428/81; 704/272; 273/148 A; 379/88, 96; 52/36.1; 40/611, 606, 615, 533, 535, 617; 235/152; 281/15.1; 462/14; 381/80; D19/20, 25

(56) References Cited

U.S. PATENT DOCUMENTS 4,721,644 A * 1/1988 Mayo ..... 428/71
4,787,516 A * 11/1988 Morrison ..... 206/566
4,940,628 A * 7/1990 Lin et al. ..... 106/31.64
4,996,110 A * 2/1991 Tanuma et al. ..... 428/343
5,009,333 A * 4/1991 Souders ..... 211/85.2
5,527,568 A * 6/1996 Boone et al. ..... 428/14
5,549,267 A * 8/1996 Armbruster et al. ..... 248/442.2
5,987,825 A * 11/1999 Rosen ..... 40/611
6,085,923 A * 7/2000 Yaniger ..... 215/355
6,132,821 A * 10/2000 Garr ..... 428/15

OTHER PUBLICATIONS

Parrot Products Online Catalog <www.lisp.com.au/–dgof/pre.html>, Dec. 18, 2000 [retrieved Jul. 8, 2003].*

* cited by examiner

*Primary Examiner*—Kurt Fernstrom
(74) *Attorney, Agent, or Firm*—Leydig, Voit & Mayer, Ltd.

(57) ABSTRACT

Tackable and markable dry erase display boards which have no frame and which may be die cut from moldable foam material capable of receiving and holding mounting pins and substantially closing after a pin is withdrawn. Such boards are light weight and can be mounted on substantially any desired surface without hardware or tools, and can be fabricated in substantially any desired color. The boards may have convenient means for holding accessories such as an eraser or marking implement.

37 Claims, 2 Drawing Sheets

DRY ERASE AND TACK DISPLAY BOARD HAVING NO FRAME

This invention relates to boards which may be used to display removably tacked on and written materials, but which have no frame for containing the tackable and writable surfaces of the board.

SUMMARY AND BACKGROUND OF THE INVENTION

Dry erase boards and tackable display boards are old in the art. These boards usually may have a tackable surface, such as cork or fiber and a markable surface, such as melamine, porcelain coated paper, metal or film. The tackable surface preferably permits a note or display to be attached to the board by a push pin or thumb tack, and preferably the pin or tack may be removed to permit mounting of another note or display. Preferably the markable surface may be erased with an eraser or wiped with a cloth, to permit another marking to be made on the markable surface.

Examples of such dry erase boards and tackable display boards may be found in several prior art patents, such as

| | |
|---|---|
| Boone et al U.S. Pat. No. 5,527,568 | Lassoff U.S. Pat. No. 5,655,323 |
| Davis et al U.S. Pat. No. 5,658,635 | Davis et al U.S. Pat. No. 5,928,756 |
| Bianco U.S. Pat. No. 5,948,498 | Davis et al U.S. Pat. No. 5,976,663 |

and others

However, all of these patents require a frame or backing and in no known patent or prior art disclosure can a combination board be mounted without a frame or backing. Additionally, the presence of the frame or backing inhibits the decorative use of more than one assembled shaped boards, for example, where one board is circular shaped and fits into another board which is of a mating crescent shape.

SUMMARY OF THE PRESENT INVENTION

Combination boards embodying the present invention can have both a tackable surface and a markable surface, and the board may be die cut in any desired shape permitting one or more boards to be die cut and assembled into any decorative form, such as free forms, geometric forms or circular forms, or a combination of such forms, without the use of special backing, frames or the like. These forms permit the fabrication of such combination boards without extra manufacturing steps or special jigs or machines to fabricating and mount and secure frames or backing.

Additionally, a board embodying the present invention may be fabricated with an eraser or pen holder and the erasable member may be mounted at almost any position, permitting great versatility for such a board. Preferably the board is fabricated from a moldable foam material, which can be die cut to any desirable shape but is relatively light in weight and thick enough to hold a push pin. The moldable material must also be rubber-like and capable of receiving multiple pin pricks, so that it may be used many times without leaving formed pin holes. A preferred material is ethyl vinyl acetate (or EVA) foam, which is capable of holding pins, and which has the ability for the pin hole to substantially close after a pin is withdrawn.

The preferred EVA foam also may be fabricated in almost any color, without over coatings, coverings, or any extra coloring steps. This feature permits these boards to be decorative or color coordinated in special environments.

A board embodying the present invention may have mounting means secured to it. Such mounting means may consist of magnetic strips, where the board is to be mounted on a metal partition wall or on a refrigerator, or double sided pressure sensitive tape strips, which permit the board to be mounted on most surfaces. Mounting may be accomplished without the use of any hardware or tools.

The markable surface may consist of a thin panel of any shape or size which is glued or otherwise secured to the EVA foam. This panel may consist of a sheet of thin laminate plastic having a film surface which can be written upon. The surface may be wiped clean without any cleaners or moisture applied, and reused. Preferably, a writing implement, such as a Sanford Expo marker, or the like, may be used. A preferred material for the markable surface of the board is dry erase styrene.

OBJECTS AND ADVANTAGES OF THE INVENTION

It is the object of the present invention to provide a dry erase and tack display board having no frame of the character referred to.

Another object is to provide a combination tackable and markable display board which has no frame or special backing.

Another object is to provide such a combination tackable and markable display board which can be die cut and assembled into substantially any convenient decorative form.

Another object is to provide such a die-cutable tackable and markable display board which can be combined and associated with another board of similar structure.

Another object is to provide such a frame-less combination tackable and markable display board which has a body structure composed of moldable material, such as ethyl vinyl acetate foam.

Another object is to provide such a frame-less combination tackable foam and markable display board which has convenient means for holding accessories such as an eraser or marking implement.

Another object is to provide a frame-less combination tackable foam and markable display board which is capable of receiving and holding mounting pins and which has the ability for the foam to substantially close after a pin is withdrawn.

Another object is to provide such a frame-less combination tackable foam and markable display board which can be fabricated from substantially any desired color.

Another object is to provide such a frame-less combination tackable foam and markable display board which is relatively light in weight and can be mounted on substantially any desired surface without hardware or tools.

Another object is to provide such a frame-less combination tackable foam and markable display board which has an erasable surface which may be wiped clean without any cleaners or applied moisture and reused.

Another object is to provide such a frame-less combination tackable foam and markable display board which is simple and easy to fabricate and which is easy to use and re-use.

These and other objects and advantages of the invention will become more apparent as this description proceeds, taken in conjunction with the accompanying drawings.

DESCRIPTION OF PREFERRED EMBODIMENTS

Figure 1:
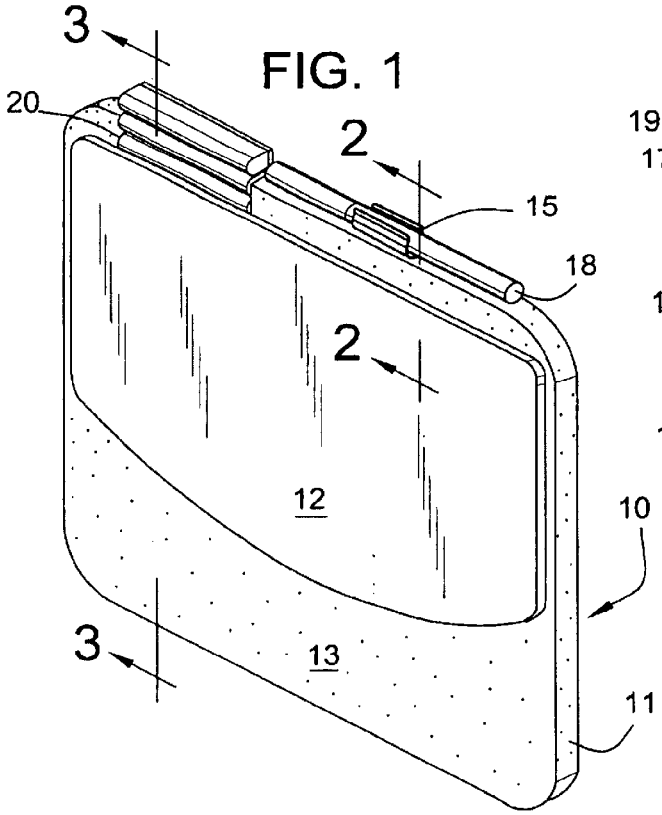
FIG. 1 is a perspective view of an exemplary dry erase and tack display board having no frame embodying the present invention.
Figure 2:
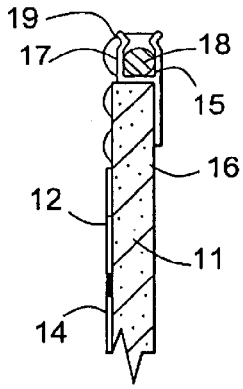
FIG. 2 is an enlarged detail sectional view of a part of such a board showing the means for securing an accessory, such as a writing implement onto the board, taken on the line 2—2 of FIG. 1.
Figure 3:
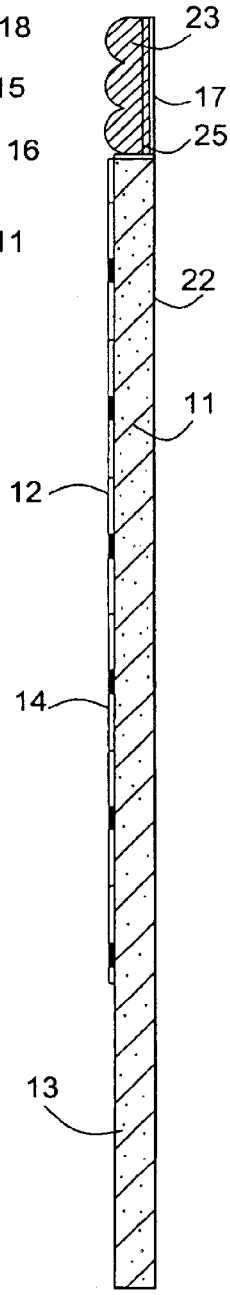
FIG. 3 is an enlarged sectional view of the board which also shows the means for securing an eraser, taken on line 3—3 of FIG. 1.
Figure 4:
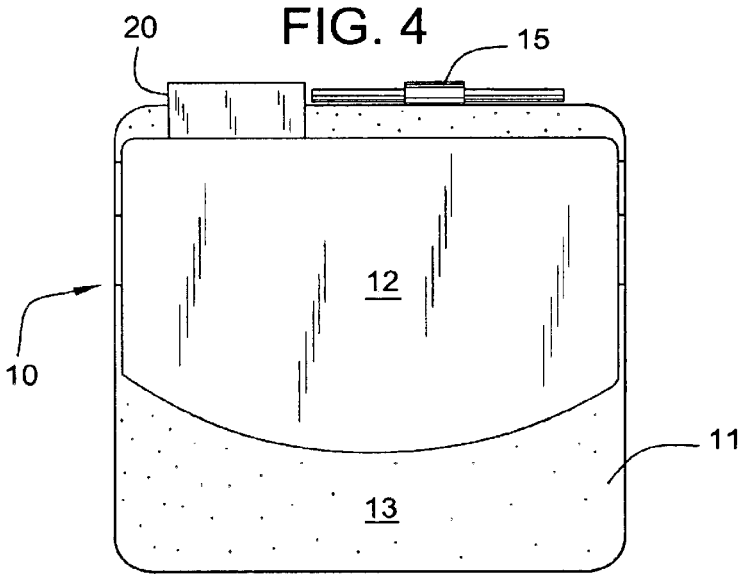
FIG. 4 is a front plan view of the board of FIG. 1.

With reference to the accompanying drawings and particularly to FIGS. 1–4, a display board 10 embodying the present invention preferably has a body 11 of molded foam material, which may be die cut from EVA foam or similar material which is light in weight and has the ability to receive and hold push pins or thumb tacks so that the pins or tacks may be removed and the holes will substantially close, to permit later mounting of other materials onto the board. The foam board has a sufficient thickness and rigidity to maintain its shape without the need for a separate structural frame or structural backing. Secured onto the face side 13 of the foam body 11 is a sheet 12 of markable material, such a dry erase styrene, which has surface 14 which may be written or marked upon and which may be erased. This sheet 12 is preferably appropriately secured to the body 11 by glue or cement.

A clip 15 may be glued to the rear side 16 of the foam body 11 and may have a channel 17 for receiving therein a pen 18 or other marking implement. This channel 17 may have snap engaging flexible legs 19 to stow the pen 18 in a desired position when not in use. A portion 20 of the foam body 11 may be cut away, and a small panel 21 may be secured, as by glue, to the rear side 22 of the board body for holding an eraser 23 in the cut away portion 20, and this eraser 23 may have a series of parallel ribs 24, facilitating holding the same by hand, and a dry absorbent erasing surface 25, such as felt, for use as an eraser to wipe clean marking placed on the surface 14 of the dry erase sheet 12.

Mounting of the board 10 may be accomplished by any conventional means (not shown) such as double sides pressure sensitive tape or pressure sensitive magnetic tape or other means.

Figure 5:
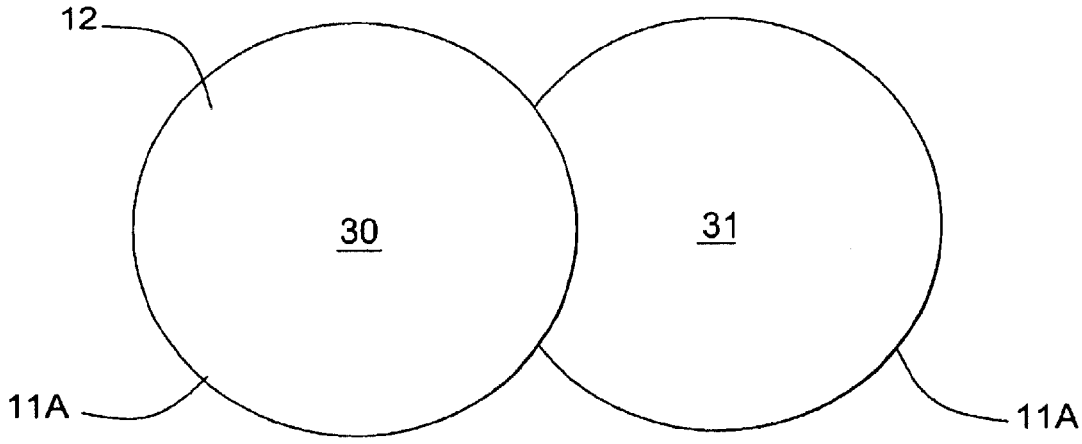
FIG. 5 is a front plan view of modified combination round and crescent boards embodying the invention which may be fit together for decorative and special purposes.
Figure 6:
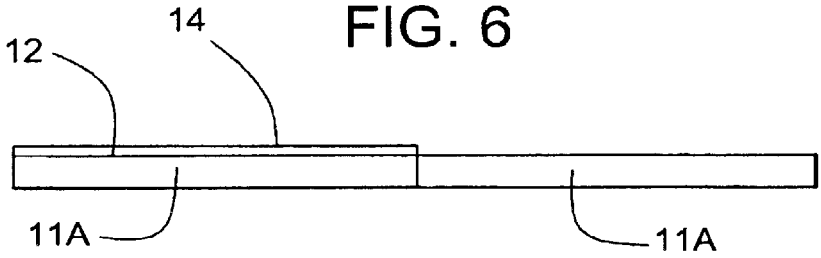
FIG. 6 is side elevational view of the combination boards shown in FIG. 5.
Figure 7:
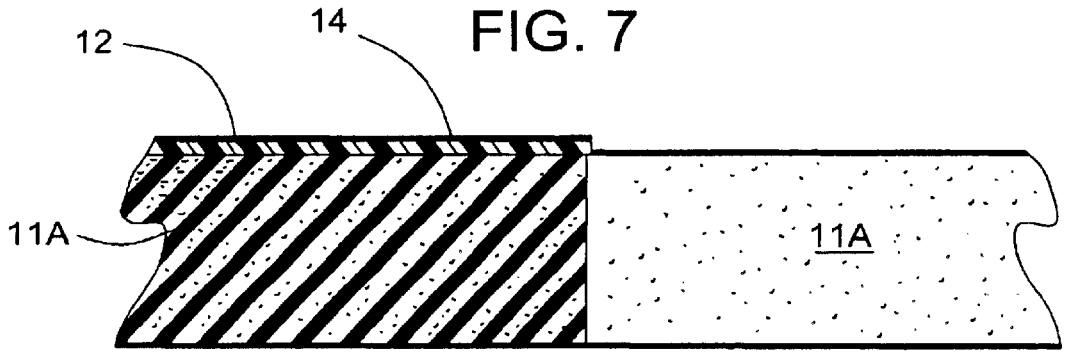
FIG. 7 is an enlarged sectional view of the board of FIG. 5, showing the convergence of the two boards and the relative position of the sheet having a markable surface.

As shown in FIGS. 5–7, foam bodies 11*a* may be die cut into any shape, such as a circle 30 and a crescent 31. One or both of these foam bodies 11*a* may comprise a sheet 12 having a markable surface 14. The dry cut foam bodies 11*a* may be nested together as shown, for decorative or other purposes. Similar cooperative foam sheets may be used, such as geometric or special shapes, utilizing the same foam tackboard and erasable materials.

While preferred embodiments of the invention have been shown and described, it is not desired that the invention should be limited to the structure or element shown, except as limited by the appended claims.

What is claimed is:

1. A tackable and markable dry-erase board assembly for receiving at least one tack and displaying an erasable writing material, the board assembly comprising:

(a) a board comprising an integral body of a moldable plastic foam material, the board having sufficient thickness and rigidity to maintain its shape without the need for a separate structural frame or structural backing, the board further comprising a mounting surface capable of receiving and holding the tack, wherein the plastic foam material is capable of substantially closing a hole made by the tack when the tack is withdrawn such that the same hole is capable of holding the tack for more than one time; and (b) a panel secured to a portion of the board mounting surface, the panel having a surface adapted to display the erasable writing material.

2. The assembly according to claim 1, wherein the moldable plastic foam material comprises ethyl vinyl acetate.

3. The assembly according to claim 1, wherein the moldable plastic foam material is a die-cut sheet.

4. The assembly according to claim 1, wherein the board is elastic.

5. The assembly according to claim 1, wherein the panel comprises a sheet of a material selected from the group consisting of melamine, porcelain, coated paper, metal, and thin laminate plastic having a film surface.

6. The assembly according to claim 1, wherein the panel is secured by glue.

7. The assembly according to claim 1, further comprising a surface-mounting means capable of securing the assembly to a surface.

8. The assembly according to claim 1, wherein the surface-mounting means comprise magnetic tape secured to the board.

9. The assembly according to claim 7, wherein the surface-mounting means comprise double-sided pressure sensitive tape secured on one side to the board.

10. The assembly according to claim 7, further comprising an eraser, and wherein the board comprises an edge, the edge having a recess eraser being removably secured in the recess.

11. The assembly according to claim 1, further comprising a clip secured on the assembly, the clip capable of removably securing a writing implement.

12. The assembly according to claim 1, further comprising a second board comprising an integral body of a moldable plastic foam material, the second board having a mounting surface capable of receiving and holding the tack, wherein the plastic foam material of the second board is capable of substantially closing a hole made by the tack when the tack is withdrawn such that the same hole is capable of holding the tack for more than one time, wherein the second board is cooperatively assembled with the first board to create a decorative form selected from the group consisting of a free form, a geometric form, a circular form, and a combination thereof.

13. The assembly according to claim 12, wherein the first and second boards are nested together to form a unitary display.

14. The assembly according to claim 12, further comprising a second panel secured to the second board.

15. The assembly according to claim 12, wherein the second board comprises the same plastic foam material as the first board.

16. The assembly according to claim 12, wherein the first and second boards have different colors.

17. The assembly according to claim 1, wherein the panel comprises a sheet of dry-erase styrene.

18. The assembly according to claim 1 further comprising a writing implement coupled to at least one of the board or panel.

19. The assembly according to claim 1 further the board comprises a peripheral edge, and the panel is spaced from at least a portion of the peripheral edge.

20. A tackable and markable dry-erase board assembly for mounting to a surface, and for receiving at least one tack and displaying an erasable writing material, the board comprising:

(a) a board comprising an one-piece body of an ethyl vinyl acetate foam material, the board having sufficient thickness and rigidity to maintain its shape without the need for a separate structural frame or structural backing, the board further comprising a mounting surface capable of receiving and holding a tack, wherein the foam material is capable of substantially closing a hole made by the tack when the tack is withdrawn such that the same hole is capable of holding the tack for more than one time;

(b) a dry-erase styrene panel secured to a portion of the board mounting surface, the panel having a surface adapted to display the erasable writing material; and (c) a surface-mounting means secured to the board and capable of securing the assembly to the surface.

21. The assembly according to claim 20, further comprising an eraser and wherein the board comprises an edge, said edge comprising a recess the eraser being removably secured in the recess.

22. A tackable and markable dry-erase board assembly for receiving at least one tack displaying an erasable writing material, the board assembly comprising:

(a) a board comprising an integral body of a plastic foam material, the board having sufficient thickness and rigidity to maintain its shape without the need for a separate structural frame or structural backing, the board further comprising a mounting surface capable of receiving and holding a tack, wherein the plastic foam material is capable of substantially closing a hole made by the tack when the tack is withdrawn such that the same hole is capable of holding the tack for more than one time; and (b) a panel secured to a portion of the board mounting surface, the panel having a surface adapted to display the erasable writing material.

23. A tackable and markable dry-erase board assembly for receiving at least one tack and displaying an erasable writing material, the board assembly comprising:

(a) a board comprising an integral body of a plastic foam material comprising ethyl vinyl acetate, the board having sufficient thickness and rigidity to maintain its shape without the need for a separate structural frame or structural backing, the board further comprising a mounting surface capable of receiving and holding the tack; and (b) a panel secured to a portion of the board mounting surface, the panel having a surface adapted to display the erasable writing material.

24. The assembly according to claim 23 wherein the plastic foam material is capable of substantially closing a hole made by the tack when the tack is withdrawn such that the same hole is capable of holding the tack for more than one time.

25. The assembly according to claim 23 wherein the board is die cut from a sheet of said plastic foam material.

26. The assembly according to claim 23 wherein the board is resilient.

27. The assembly according to claim 23 wherein the panel comprises a sheet of material selected from a group consisting of melamine, porcelain, coated paper, metal, and thin laminate plastic having a film surface.

28. The assembly according to claim 23 further comprising dry erase pen coupled to the board.

29. The assembly according to claim 28 further comprising a clip coupled to the board, said clip being functional to couple the pen to the assembly.

30. The assembly according to claim 23 further comprising an eraser.

31. The assembly according to claim 23 further comprising at least one magnet coupled to the assembly for mounting the assembly to a surface.

32. The assembly according to claim 23 further comprising double sided tape for mounting the assembly to a surface.

33. The assembly according to claim 23 wherein further comprising mounting structure operable to mount the board to a surface.

34. The assembly according to claim 23 further comprising a second board comprising a body of a plastic foam material, the plastic foam material comprising ethyl vinyl acetate, the second board having a mounting surface capable of receiving and holding the tack, the second board being cooperatively assembled with the first board to create a decorative form.

35. The assembly according to claim 34 further comprising a second panel secured to the second board.

36. The assembly according to claim 34 comprising further foam structures selected from the group consisting of a free form, a geometric form, a circular form, and a combination thereof.

37. The assembly according to claim 23 comprising further foam structures selected from the group consisting of a free form, a geometric form, a circular form, and a combination thereof.

* * * * *

UNITED STATES PATENT AND TRADEMARK OFFICE

CERTIFICATE OF CORRECTION

PATENT NO. : 6,837,715 B2
DATED : January 4, 2005
INVENTOR(S) : Beno

It is certified that error appears in the above-identified patent and that said Letters Patent is hereby corrected as shown below:

Column 4,
Line 35, "claim 1" should read -- claim 7 --.
Line 41, "claim 7" should read -- claim 1 --.

Column 5,
Line 8, "further" should read -- wherein --.
Line 31, "recess the" should read -- recess, the --.

Signed and Sealed this

Twenty-fourth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,837,715 B2
DATED : January 4, 2005
INVENTOR(S) : Beno

It is certified that error appears in the above-identified patent and that said Letters Patent is hereby corrected as shown below:

Title page,
Item [54], Title, should read -- TACKABLE AND MARKABLE DRY ERASE BOARD ASSEMBLY --.

Signed and Sealed this

Second Day of August, 2005

JON W. DUDAS
*Director of the United States Patent and Trademark Office*